US006561609B2

(12) United States Patent
Bauer

(10) Patent No.: US 6,561,609 B2
(45) Date of Patent: May 13, 2003

(54) MULTIPLE DROP WEIGHT PRINTING SYSTEM

(75) Inventor: Stephen W. Bauer, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/922,432

(22) Filed: Aug. 3, 2001

(65) Prior Publication Data

US 2003/0025750 A1 Feb. 6, 2003

(51) Int. Cl.[7] ..... B41J 2/205; B41J 2/21

(52) U.S. Cl. ..... 347/15; 347/43

(58) Field of Search ..... 347/43, 15

(56) References Cited

U.S. PATENT DOCUMENTS 4,860,026 A * 8/1989 Matsumoto et al. ..... 347/43
6,227,640 B1 5/2001 Maze et al. ..... 347/15
6,293,643 B1 * 9/2001 Shimada et al. ..... 347/15

* cited by examiner

*Primary Examiner*—Thinh Nguyen

(57) ABSTRACT

Printing is performed by depositing dots of ink having the same color but different colorant loads. A higher drop weight is used for the lower colorant load ink, and a lower drop weight is used for the higher colorant load ink.

13 Claims, 2 Drawing Sheets

FIG. 1
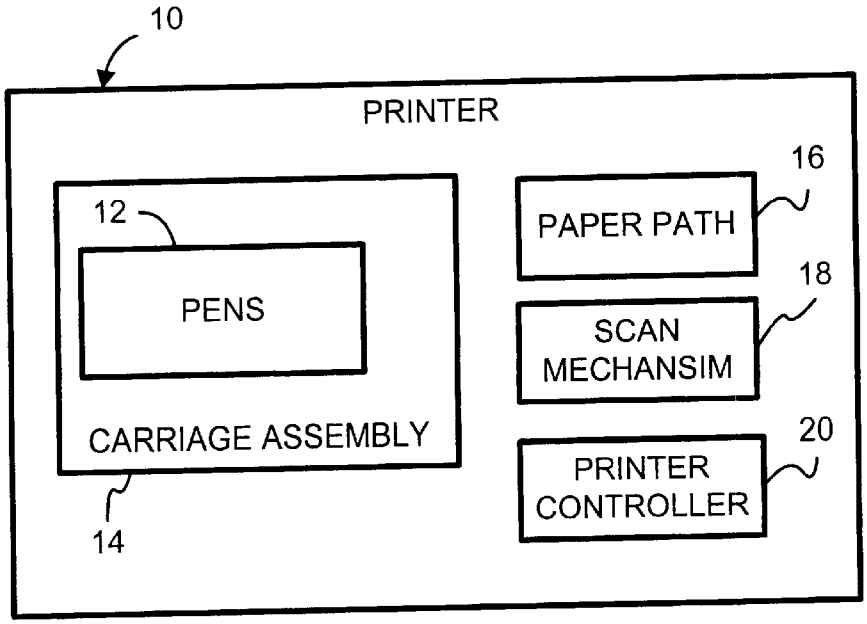
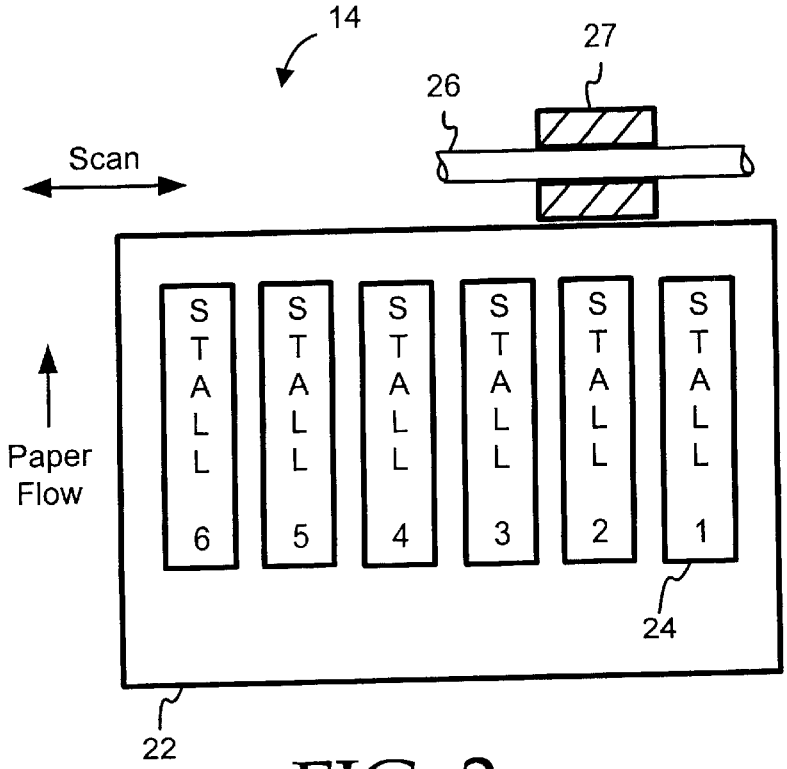
FIG. 2

MULTIPLE DROP WEIGHT PRINTING SYSTEM

BACKGROUND

The present invention relates to printing systems. More specifically, the present invention relates to inkjet printing systems and other printing systems that deposit dots of ink on printing media.

Inkjet printing technology is used in a wide variety of products. Commercial products include printers, graphics plotters, copiers, facsimile machines, and all-in-one machines.

A typical color inkjet product prints with four basic colors: cyan (C), magenta (M), yellow (Y), and black (K). Low end printers, for example, usually include four pens, one for each color (a typical pen, also referred to as a printhead, includes one or two columns of vertically-oriented nozzles, and each nozzle ejects a color ink dot when thermally actuated).

High end printers, in contrast, usually include more than one pen for cyan and magenta. For example, a six-pen printer might have a dark cyan pen, a light cyan pen, a dark magenta pen, a light magenta pen, a yellow pen, and a black pen. Thus this six pen printer uses different shades of cyan and magenta. Higher quality pictures can be produced by using inks having different colorant loads for cyan and magenta.

The different shades can be achieved by using inks having different colorant loads. For instance, different shades can be achieved by using inks having different dye loads or pigment loads. Dark cyan has a higher colorant load than light cyan, and dark magenta has a higher colorant load than light magenta.

During a printing operation, a sheet is moved along a paper flow axis. Each pen may be scanned across the sheet in a scan direction. As each pen is scanned across the sheet, it lays down a swath of ink dots.

If dots are misplaced, they tend to clump together. The clumping can cause edges of the swaths to become visible and horizontal streaks to appear. These visible artifacts are commonly referred to as "banding." The banding tends to degrade image quality.

As nozzles are fired repeatedly, they become hotter and hotter. As the temperature rises, drop volume variation increases and color shifts result. The color shifts also tend to degrade image quality.

It would be desirable to reduce the banding and the color shifts.

SUMMARY

One aspect of the present invention is a method of printing with first and second inks of the same color but different colorant loads. The method includes using a higher ink drop weight for the lower colorant load ink and a lower ink drop weight for the higher colorant load ink.

Other aspects and advantages of the present invention will become apparent from the following detailed description, taken in conjunction with the accompanying drawings, illustrating by way of example the principles of the present invention.

BRIEF DESCRIPTION OF THE DRAWINGS

FIG. 1 is an illustration of an inkjet printer.

FIG. 2 is an illustration of a carriage assembly for the inkjet printer.

DETAILED DESCRIPTION

Figure 3:
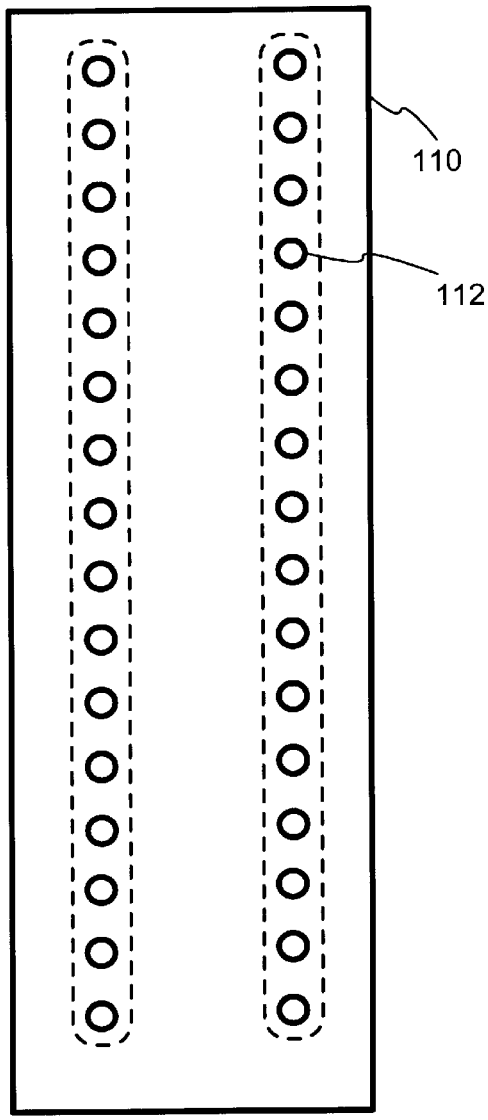
FIG. 3 is an illustration of a pen for the inkjet printer.

FIG. 1 shows an inkjet printer 10 including multiple pens 12, a carriage assembly 14 for carrying the pens 12, a paper path 16 for advancing a sheet or other print medium beneath the pens 12, and a scan mechanism 18 for scanning the pens 12 across the print medium. The printer 10 also includes a printer controller 20 (e.g., an embedded processor and embedded read-only memory storing firmware for the processor) for receiving swath data from a host (e.g. a host computer) and using the swath data to fire nozzles of the pens 12. Each bit of the swath data indicates whether a pen nozzle should be actuated at a specific position along the sheet. The printer controller 20 also controls the carriage assembly 14, the paper path 16 and the scan mechanism 18.

FIG. 2 shows the carriage assembly 14 and scan mechanism 18 in greater detail. The scan mechanism 18 may include a rail 26 and a bushing 27. The bushing 27 secures a mounting plate 22 to the rail 26 and allows the mounting plate 22 to slide along the rail 26 in a scan direction. The scan mechanism 18 further includes a motor (e.g., a stepper motor, a servo DC motor) and transmission for moving the mounting plate 22 along the rail 26. The motor and transmission are not shown in FIG. 2.

The carriage assembly 14 includes six pen stalls 24 secured to the mounting plate 22. Each pen stall 24 accommodates a pen. Although the stalls 24 are shown as being in-line, one or more of the stalls 24 may be offset. Although six stalls 24 are shown, the carriage assembly 14 may have a fewer number of pen stalls or it may have a greater number of pen stalls.

At least two of the pens print the same color, but have different colorant loads. The ratio of heavy colorant load to light colorant load for a color can vary between 2:1 and 5:1. For example, ink in a first pen has a light colorant load of cyan for printing a light cyan, while ink in a second pen has three times the colorant load for printing a dark cyan; and ink in a third pen has a light colorant load of magenta for printing a light magenta, while ink in a fourth pen has twice the colorant load for printing a dark magenta. Fifth and sixth pens might contain yellow and black ink. If the carriage assembly 14 has two additional pens, the inks in those two additional pens might contain even heavier or lighter colorant loads of cyan and magenta.

In general, smaller drop sizes are used for the darker colors, which are more visible. Drop weights for the lighter colors should be at least 1.3 to 2 times greater than drop weights for the darker colors. For example, the printer 10 may use a drop weight of 4 nanograms for a dark cyan ink and a drop weight of 8 nanograms for a light cyan ink.

The smaller drop weights have the potential for higher image quality. The drop weight for the dark colors is preferably low so individual dots are not perceived by the human eye.

A higher drop weight pen puts more ink on a page with each drop, and the ink spreads out more. Hence, spot size is larger for higher drop weight pens. The lighter colors may have higher drop weights because the typical human eye does not perceive large, light-colored dots. Larger drop weight drops are more reliable to print, they cost less to print, and they have improved banding robustness. Larger spots are more robust to banding for a given amount of system error in dot placement. Using the different drops weights for different colorant loads of the same color combines the banding robustness of high drop weight light inks with the reduced dot visibility of low drop weight dark inks.

Reference is now made to FIG. 3. Each pen 110 typically includes one or two columns of vertically-oriented nozzles 112. Drop weight is proportional to nozzle diameter and resistance area. Thus drop weight can be increased by increasing nozzle diameter and resistance area. Higher drop weight pens are more thermally efficient than lower drop weight pens. They require less energy per ejected nanogram of ink. They can also deliver higher volumes of ink over their lifetimes, which lowers the cost of printing.

Reference is once again made to FIGS. 1 and 2. During a printing operation, the paper path 16 moves a sheet in incremental distances along a paper flow direction. After the sheet has been moved into a print zone, the scan mechanism 18 moves the mounting plate 22 in the scan direction at a scan velocity. The printer controller 20 causes the nozzles to fire and deposit color dots on the sheet as the mounting plate 22 is scanned along the sheet. As each pen is scanned across the sheet, it can lay down a swath of ink dots. After a swath of dots has been printed across the sheet, the printer controller 20 commands the paper path 14 to advance the sheet by an incremental distance. The printer controller 20 also sends a request for new swath data. After the swath data has been received, the printer 10 prints a new swath of dots. The printer 10 continues printing swaths until the sheet has been printed.

The printer 10 may use the different drop weight inks to print ramped print masks. Ramped print masks are described in assignee's U.S. Pat. No. 6,238,112.

Consider the following example. The printer 10 has a 15 nanogram/1200 dpi ink limit, uses 7 nanogram drop weight pens for the lighter inks and 5 nanogram drop weight pens for the darker inks, and prints in a two-bit halftone. Each two bits of swath data indicates whether zero, one, two or three drops per pixel are deposited. Nozzle spacing is 600 dpi and the printing resolution is 1200 dpi. To use a 600 dpi array of nozzles to print a 1200 dpi resolution image, the printer 10 uses four passes per pixel.

Figure 4:
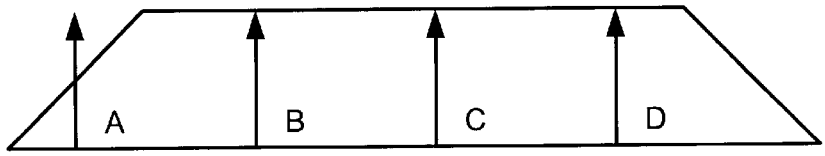
FIG. 4 is an illustration of a ramped print mask profile.

The printer 10 prints a ramped print mask profile using the exemplary profile shown in FIG. 4. Four nozzles A, B, C and D (each represented by a vertical arrow) have the chance to deposit a dot at a given pixel. In a ramped mask, the middle nozzles are used more frequently than the outer nozzles. The ramped mask assigns the following firing probabilities to the four nozzles A, B, C and D: nozzle A=10%; nozzle B=30%; nozzle C=30%; and nozzle D=30%. Thus, nozzles B, C and D are likely to fire at three times the frequency of nozzle A.

If a pixel requires 15 nanograms for 1200 dpi printing, then it requires 15 nanograms/pixel divided by 7 nanograms/drop or 2.14 drops/pixel. If all nozzles A, B, C and D are firing, 10% of the ink would be printed by nozzle A on the first pass, 30% of the ink would be printed by nozzle B on the second pass, 30% of the ink would be printed by nozzle C on the third pass, and 30% of the ink would be printed by nozzle D on the fourth pass. Nozzle A would deposit 0.214 drops/pixel, and nozzles B, C and D would each deposit 0.642 drops per pixel. A half-toning algorithm (typically executed by the host that supplies the swath data) takes care of selecting the best integer value of dots/pixel per nozzle to obtain the desired average non-integer ink drop value across the printed sheet.

If the third nozzle C goes out, then the first nozzle A can still be fired at 10%, but the firing frequency of the second and fourth nozzles B and D are increased to 45% (the firing frequency of the third nozzle C is 0%). Thus nozzle A can still deposit 0.214 drops/pixel, but nozzles B and D now deposit 0.963 drops per pixel. For nozzle substitution, the lower-usage nozzle is maintained at the same firing probability, but the higher-usage nozzles have a higher firing probability. Therefore, by using the larger drop weight for lighter colors, total ink flux (nanograms/pixel/sec) can be maintained while substituting nozzles.

Now consider a single drop weight printing system having the same lower drop weight of 5 nanograms. If light cyan requires 15 nanograms/1200 dpi, but the third nozzle C of the light cyan pen is out, then each remaining nozzle A, B and D will have to fire continuously to deposit a 15 nanogram dot for 1200 dpi printing. Since the first nozzle A must fire at the same frequency as the second and fourth nozzles B and D, there is no ramped mask, and banding robustness is reduced.

The multiple drop weight printing system offers several advantages over single drop weight printing systems using the same lower drop weight. Printing with larger drop weights for the lower colorant loads costs less per page and has the same image quality as printing with the same drop weight for all colors and colorant loads. Banding is reduced because dot clumping is reduced.

The multiple drop weight printing system uses fewer passes to create ramped print masks. The ramped print masks also reduce banding visibility.

Nozzle substitution constraints are eased because the lighter inks are used at a higher flux rate than the dark inks. The nozzle substitution allows for detect-free prints when nozzles are defective.

Average pen life in the multiple drop weight printing system is more uniform than average pen life in single drop weight printing systems. In single drop weight systems, the lighter color pens are usually fired far more frequently than the darker color pens because lighter color inks are usually used far more frequently than darker color inks. In a multi-drop weight printing system where drop weight of the lighter color inks is higher than drop weight of the darker color inks, the pens containing the lighter color inks are fired at a frequency that is closer to that of the pens containing the darker color inks.

Color shifts are minimized because nozzles are not fired as frequently for the lighter colors. Since the nozzles are not fired as frequently, nozzle temperature excursions are reduced. Thus color uniformity is improved.

The printer is not limited to six pens, nor is it limited to cyan, magenta, yellow and black pens. Other colors and other numbers of pens may be used.

The present invention is not limited to the specific embodiment described above. Instead, the present invention is construed according to the claims the follow.

What is claimed is:

1. A method of printing comprising using a first pen having a first fixed drop weight to deposit dots of a first ink on a print medium and using a second pen having a second fixed drop weight to deposit a second ink on the print medium, the first and second inks having the same color, the first ink having a higher colorant load and a lower drop weight than the second ink.

2. The method of claim 1, wherein the drop weight of the second ink is about 1.3–2 times greater than the drop weight of the first ink.

3. A method of printing comprising using an inkjet printer to deposit dots of first and second inks on a print medium, the first and second inks having the same color, the first ink having a higher colorant load and a lower drop weight than the second ink, the dots of the first and second inks used in ramped print masks.

4. The method of claim 3, wherein multiple nozzles are used to print the dots; and wherein when a nozzle goes out, a lower-usage nozzle is maintained at the same firing probability, but at least one higher-usage nozzle is increased to a higher firing probability.

5. A method of reducing banding while printing dots of a color, the method comprising using a higher drop weight for lighter color dots, and a lower drop weight for darker color dots, wherein the drop weight for the lighter color dots is about 1.3–2 times greater than the drop weight for the darker color dots.

6. The method of claim 5, wherein an inkjet printer is used to print the dots.

7. A method of reducing banding while printing dots of a color, the method comprising printing ramped print masks of the dots using a higher drop weight for lighter color dots and a lower drop weight for darker color dots.

8. The method of claim 7, wherein an inkjet printer is used to print the dots; and wherein when a nozzle of the pen goes out, a lower-usage nozzle is maintained at the same firing probability, but at least one higher-usage nozzle is increased to a higher firing probability.

9. A printing apparatus comprising first and second pens, the first pen having a first fixed drop weight, the second pen having a second fixed drop weight, the pens using first and second inks of the same color but different colorant loads, drop weight for the lower colorant load ink being greater than drop weight for the higher colorant load ink.

10. The printing apparatus of claim 9, wherein the drop weight for the lower colorant load ink is about 1.3–2 times greater than the drop weight for the higher colorant load ink.

11. A printing apparatus comprising:

first and second pens, the pens using first and second inks of the same color but different colorant loads, drop weight for the lower colorant load ink being greater than drop weight for the higher colorant load ink; and.

a controller for controlling the pens to print the dots in ramped print masks.

12. The printing apparatus of claim 11, wherein when a nozzle of the higher drop weight pen goes out, the printer controller maintains a lower-usage nozzle at the same firing probability, but increases at least one higher-usage nozzle to a higher firing probability.

13. A printer comprising first and second pens, the first pen making dots about 1.3–2 times larger than the second pen, the first and second pens being filled with ink of the same color, the ink in the second pen having 2–5 times the colorant load of the ink in the first pen.

* * * * *